US008434843B2

(12) United States Patent
Murai et al.

(10) Patent No.: US 8,434,843 B2
(45) Date of Patent: May 7, 2013

(54) PRINTING APPARATUS, PRINTING METHOD, AND PROGRAM

(75) Inventors: Kiyoaki Murai, Suwa (JP); Nobuhiro Karito, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 329 days.

(21) Appl. No.: 12/624,125

(22) Filed: Nov. 23, 2009

(65) Prior Publication Data

US 2010/0134545 A1 Jun. 3, 2010

(30) Foreign Application Priority Data

Nov. 28, 2008 (JP) ..... 2008-304148
Jul. 23, 2009 (JP) ..... 2009-172396

(51) Int. Cl.
*B41J 29/38* (2006.01)
*B41J 2/015* (2006.01)
*B41J 2/15* (2006.01)

(52) U.S. Cl.
USPC ..... 347/12; 347/13; 347/20; 347/40

(58) Field of Classification Search ..... 347/12–13, 347/40, 42, 20
See application file for complete search history.

(56) References Cited

U.S. PATENT DOCUMENTS 7,237,871 B2 * 7/2007 Yamaguchi et al. ..... 347/42
2005/0212853 A1 * 9/2005 Eguchi et al. ..... 347/40

FOREIGN PATENT DOCUMENTS

| | | | |
|---|---|---|---|
| JP | 05-057965 | A | 3/1993 |
| JP | 2003-285434 | A | 10/2003 |
| JP | 2004-050445 | A | 2/2004 |
| JP | 2005-161733 | A | 6/2005 |
| JP | 2006-035731 | A | 2/2006 |
| JP | 2006-224569 | A | 8/2006 |

* cited by examiner

*Primary Examiner* — Jason Uhlenhake
(74) *Attorney, Agent, or Firm* — Kilpatrick Townsend & Stockton LLP

(57) ABSTRACT

A printing apparatus includes a line head which includes first and second basic heads each having a plurality of nozzles in a predetermined direction and in which the first and second basic heads are arranged in the predetermined direction so as to form an overlapping section in the predetermined direction and a controller which controls the first and second basic heads when at least one of a print medium and the line head moves in a direction intersecting the predetermined direction and which controls the first and second basic heads so as to print the contour of a character or a line image by using only one of the first and second basic heads when the character or the line image is contained in an image printable by the overlapping section.

9 Claims, 15 Drawing Sheets

FIG. 15

| OVERLAPPING SECTION | LEFT HEAD | RIGHT HEAD |
|---|---|---|
| A | FIRST ROW | THIRD ROW |
| B | SECOND ROW | FIRST ROW |
| C | THIRD ROW | SECOND ROW |

FIG. 16

| POSITION START POINT | POSITION END POINT | OVERLAPPING SECTION |
|---|---|---|
| 0 | a1s | NO |
| a1s | a1e | A |
| a1e | b1s | NO |
| b1s | b1e | B |
| b1e | c1s | NO |
| c1s | c1e | C |
| c1e | a2s | NO |
| a2s | a2e | A |
| ⋮ | ⋮ | ⋮ |

PRINTING APPARATUS, PRINTING METHOD, AND PROGRAM

This application claims priority to Japanese Patent Application No. 2008-304148, filed Nov. 28, 2008 and Japanese Patent Application No. 2009-172396, filed Jul. 23, 2009 the disclosures of which are incorporated by reference herein.

BACKGROUND

1. Technical Field

The present invention relates to a printing apparatus such as an ink jet printer and a printing method.

2. Related Art

In the past, there was a known printing apparatus including a line head in which a plurality of heads with a plurality of print elements are arranged substantially in series in a sub-scanning direction and an overlapping section where two heads overlap with each other is formed in a connection region of the heads, as disclosed in JP-A-5-57965, JP-A-2004-50445, and JP-A-2006-224569.

More specifically, in the printing apparatus disclosed in JP-A-5-57965, the number of print elements of one head is gradually decreased in the overlapping section and the number of print elements of the other head is gradually increased in the overlapping section.

In the printing apparatus disclosed in JP-A-2004-50445, the driving positions of the printing elements of one head and the other head are configured to be switched in the overlapping section upon the driving the printing elements.

In the printing apparatus disclosed in JP-A-2006-224569, the dither size and the position of the overlapping section are configured to be adjusted.

In these known techniques, two or more heads forming the overlapping section are different from each other in characteristics such as landing precision, a landing size, and assembly precision. Therefore, when characters or line images are printed by the overlapping section, deterioration in the image quality cannot be avoided, compared with the image quality achieved when the same heads print the characters or the line images.

SUMMARY

An advantage of some aspects of the invention is that it provides a printing apparatus capable of inhibiting the deterioration in the quality of characters or line images, which is caused due to the difference in the characteristics of heads, when the characters or the line images are printed in an overlap section of the heads having the different characteristics.

According to an aspect of the invention, there is provided a printing apparatus including (A) a line head which includes first and second basic heads each having a plurality of nozzles in a predetermined direction and in which the first and second basic heads are arranged in the predetermined direction so as to form an overlapping section in the predetermined direction and (B) a controller which controls the first and second basic heads when at least one of a print medium and the line head moves in a direction intersecting the predetermined direction and which controls the first and second basic heads so as to print the contour of a character or a line image by using only one of the first and second basic heads when the character or the line image is contained in an image printable by the overlapping section.

Other aspects of the invention are apparent from the specification and the accompanying drawings.

BRIEF DESCRIPTION OF THE DRAWINGS

The invention will be described with reference to the accompanying drawings, wherein like numbers reference like elements.

FIG. 15 is a table used to explain the basic heads used in each overlapping section.

FIG. 16 is a diagram illustrating an example of the table used to explain the overlapping sections.

DESCRIPTION OF EXEMPLARY EMBODIMENTS

Figure 1:
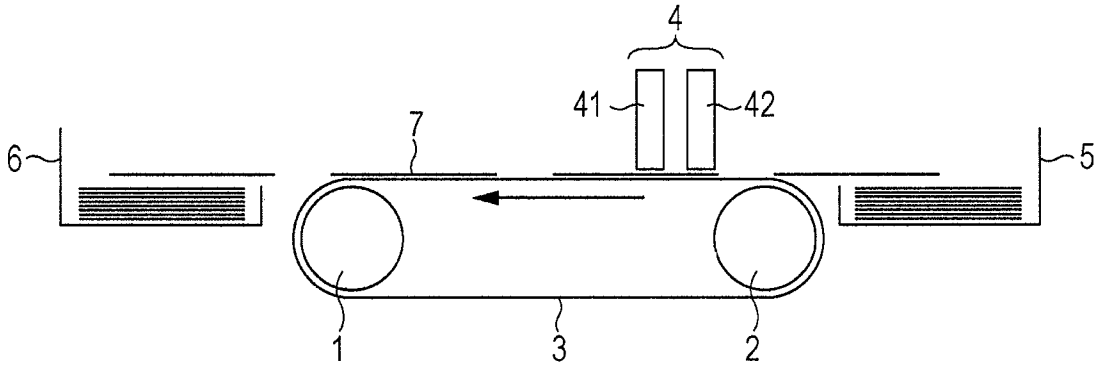
FIG. 1 is a front view illustrating the overall configuration of a printing apparatus according to an embodiment.

At least the following aspects are apparent from the description of the specification and the accompanying drawings.

According to an aspect of the invention, there is provided a printing apparatus including (A) a line head which includes first and second basic heads each having a plurality of nozzles in a predetermined direction and in which the first and second basic heads are arranged in the predetermined direction so as to form an overlapping section in the predetermined direction and (B) a controller which controls the first and second basic heads when at least one of a print medium and the line head moves in a direction intersecting the predetermined direction and which controls the first and second basic heads so as to print the contour of a character or a line image by using only one of the first and second basic heads when the character or the line image is contained in an image printable by the overlapping section.

In the printing apparatus having the above configuration, the overlapping section may have first and second boundaries in the predetermined direction. The controller may determine whether the character or the line image passes over the first or second boundary when the character or the line image is contained in the image printable by the overlapping section, and controls the first and second basic heads on the basis of the determination result.

In the printing apparatus having the above configuration, the controller may control the first and second basic heads so that one of the first and second basic heads capable of printing an area, which contains the boundaries over which the character or the line image passes, prints the contour of the character or the line image, when the character or the line image passes over one of the first and second boundaries.

In the printing apparatus having the above configuration, the controller may control the first and second basic heads so that one of the first and second basic heads prints the contour of the character or the line image and the first and second basic heads print other portions of the character or the line image, when the character or the line image passes over the first and second boundaries.

In the printing apparatus having the above configuration, the controller may control the first and second basic heads so that the first and second basic heads print an area of a predetermined width from one of the first and second boundaries in the character or the line image, when the character or the line image passes over the first and second boundaries.

In the printing apparatus having the above configuration, the controller may control the first and second basic heads so that the first and second basic heads print the image, when the character or the line image is not contained in the image printable by the overlapping section.

In the printing apparatus having the above configuration, the nozzle pitch of the first basic head may be the same as the nozzle pitch of the second basic head.

In the printing apparatus having the above configuration, in the overlapping section, the first and second basic head are disposed so that the nozzles of the first basic head and the nozzles of the second basic nozzles may overlap with each other in the predetermined direction.

According to another aspect of the invention, there is provided a printing method performed by a printing apparatus including a line head which includes first and second basic heads each having a plurality of nozzles in a predetermined direction and in which the first and second basic heads are arranged in the predetermined direction so as to form an overlapping section in the predetermined direction. The printing method includes: determining whether a character or a line image is contained in an image printable by the overlapping section; and printing the contour of the character or the line image by using only one of the first and second basic heads when the character or the line image is contained in the image printable by the overlapping section.

According to still another aspect of the invention, there is provided a program controlling a printing apparatus including a line head which includes first and second basic heads each having a plurality of nozzles in a predetermined direction and in which the first and second basic heads are arranged in the predetermined direction so as to form an overlapping section in the predetermined direction. The program causes a computer to execute: determining whether a character or a line image is contained in an image printable by the overlapping section; and printing the contour of the character or the line image by using only one of the first and second basic heads when the character or the line image is contained in the image printable by the overlapping section.

Embodiment

Hereinafter, an exemplary embodiment of the invention will be described with reference to the drawings.

Overall Configuration of Printing Apparatus

The overall configuration of a printing apparatus according to this embodiment will be described with reference to FIG. 1.

The printing apparatus according to this embodiment is a line printer shown in FIG. 1, for example. The printing apparatus includes transport rollers 1 and 2, a belt 3, a line head 4, a sheet supply unit 5, and a sheet discharge unit 6.

The transport rollers 1 and 2 are suspended on the belt 3. When a transport motor (not shown) rotates, the transport rollers 1 and 2 rotate and thus the belt 3 moves round. Therefore, a sheet 7 which is an example of a print sheet is transported on the belt 3. The line head 4 which performs printing by ejecting ink droplets onto the print sheet 7 being transported on the belt 3 is disposed at a predetermined position above the belt 3, as described below.

The sheet supply unit 5 disposed at one end of the belt 3 supplies the sheet 7 onto the belt 3 one by one. The sheet discharge unit 6 disposed at the other end of the belt 3 discharges the sheet 7 on which desired printing is completely performed by the lined head 4 while the sheet 7 is transported on the belt 3.

Configuration of Line Head

Figure 2:
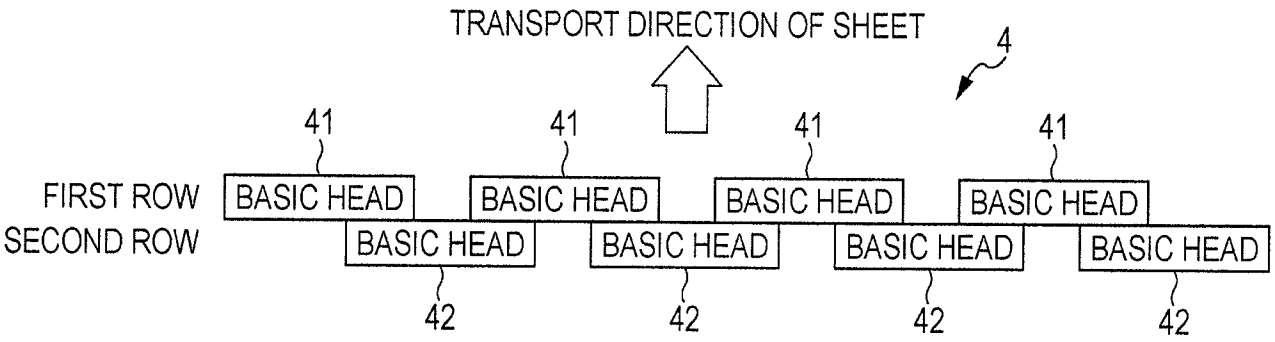
FIG. 2 is a plan view illustrating a configuration example of a line head.
Figure 3:
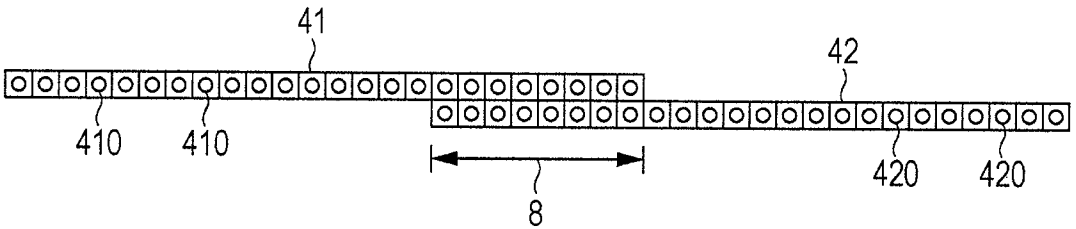
FIG. 3 is an explanatory diagram illustrating an overlapping section of the line head.

FIGS. 2 and 3 are diagrams illustrating a configuration example of the line head 4 shown in FIG. 1.

In the line head 4, first row basic heads 41 and second row basic heads 42 are alternately arranged in a direction intersecting a transport direction of the sheet 7, as shown in FIGS. 1 and 2. The basic heads 41 and 42 are arranged substantially in series as a whole.

The basic heads 41 each have a plurality of nozzles 410 serving as print elements ejecting ink droplets, as shown in FIG. 3. The plurality of nozzles 410 is arranged in a longitudinal direction of the basic heads 41. Likewise, the second row basic heads 42 each have a plurality of nozzles 420 ejecting ink droplets. The plurality of nozzles 420 is arranged in a longitudinal direction of the basic heads 42.

Here, the longitudinal direction of the basic heads 41 and 42 refer to a direction intersecting the transport direction of the sheet 7 (see FIG. 2).

Each of the basic heads 41 and each of the basic heads 42 have a connected portion, as shown in FIG. 3. In this connected portion, an overlapping section 8 where two basic heads 41 and 42 overlap with each other is formed. The overlapping section 8 has two boundaries in the direction interesting the transport direction of the sheet 7 (see FIG. 6).

Configuration of Control Processing System of Printing Apparatus

Next, the functional configuration of a control processing system of the printing apparatus according to this embodiment will be described with reference to FIG. 4.

In the printing apparatus according to this embodiment, the line head 4 is constituted by the basic heads 41 and 42 and has the overlapping section 8. With such a configuration, when an image (hereinafter, referred to as a print image) to be printed is acquired, it is necessary to control the basic heads 41 and 42 so that one of the basic heads 41 and 42 print the pixels of the acquired print image.

Figure 4:
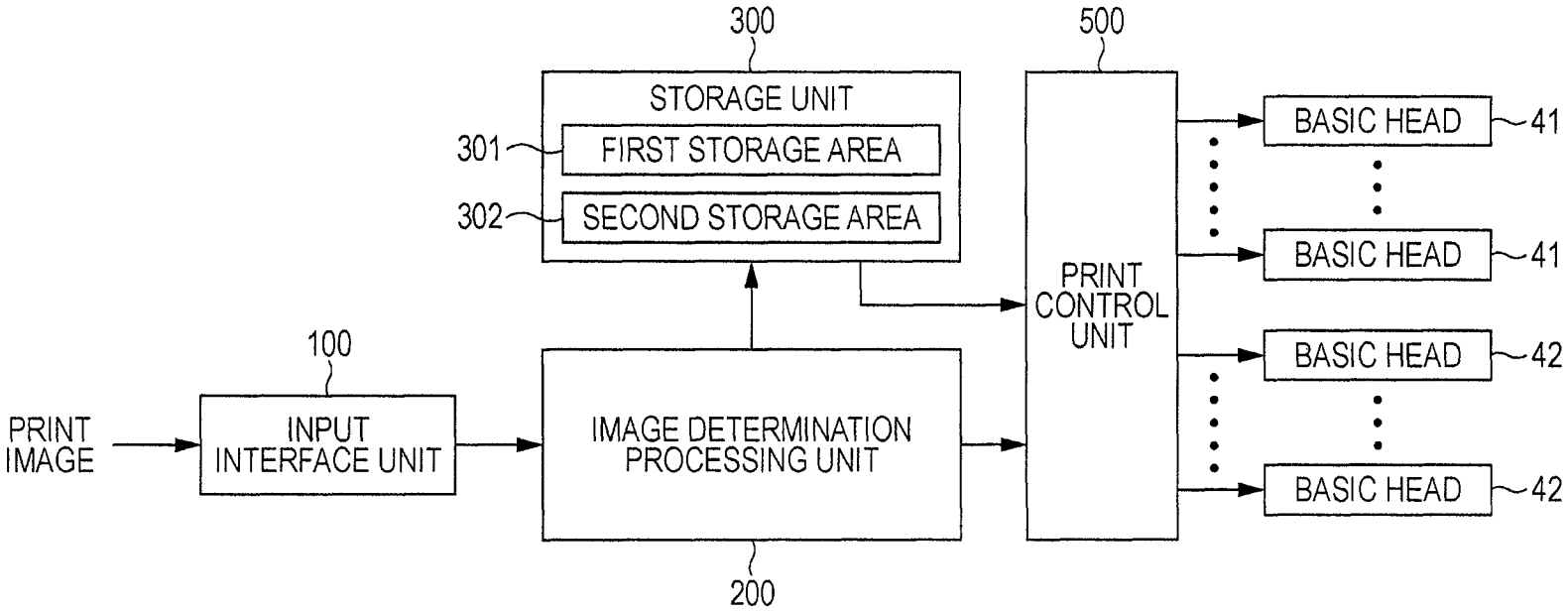
FIG. 4 is a block diagram illustrating a configuration example of a control processing system of the printing apparatus according to the embodiment.

The control processing system of the printing apparatus according to this embodiment includes an input interface unit 100, an image determination processing unit 200, a storage unit 300, and a print control unit 500, as shown in FIG. 4. The control processing system controls the printing (controls ejection of ink) of the first row basic heads 41 and the second row basic heads 42.

Here, the print image which is printed by the printing apparatus according to this embodiment includes an object image, a character, and a line image (figure or the like).

The input interface unit 100 acquires the print image from a computer or the like and outputs the acquired print image to the image determination processing unit 200.

The image determination processing unit 200 performs a determination process on the acquired print image, as described below, assigns printing to the basic heads 41 and 42 to all pixels in accordance with this determination, and generates print data (nozzle control data indicating whether to eject ink) used to eject the ink for every nozzle of the assigned basic heads. The generated print data are stored in the storage unit 300.

The image determination processing unit 200 includes a CPU, a RAM, and a ROM. The CPU executes the determination process, which is described below, in accordance with a program stored in advance in the ROM. Upon performing this determination process, the RAM is used as a work memory.

The storage unit 300 includes a first storage area 301 and a second storage area 302 and stores the print data generated in the image determination processing unit 200. The print data used to eject the ink from the nozzles 410 of the basic heads 41 are stored in the first storage area 301. The print data used to eject the ink from the nozzles 420 of the basic heads 42 are stored in the second storage area 302.

The print control unit 500 reads the print data stored in the storage unit 300 at predetermined time and controls the ejection of the ink from the nozzles 410 of the basic heads 41 or the nozzles 420 of the basic heads 42 on the basis of the read print data.

Exemplary First Determination Process

Next, an exemplary first determination process of the image determination processing unit 200 of the printing apparatus according to this embodiment will be described with reference to FIGS. 5 and 6.

The outline of the exemplary first determination process is as follows.

The print image to be printed by the line head 4 is divided into a character and others, printing the character and the others are assigned to the basic heads 41 and 42 in accordance with this division, and the character and the others are printed by the assigned basic heads.

Hereinafter, the exemplary first determination process will be described in more detail.

In step S101, the line head 4 acquires the print image. Here, the acquired print image includes an object image, a character, and a line image (such as a figure).

In step S102, it is determined whether the acquired print image is an image with character pixels. When it is determined that the acquired print image is the image with character pixels, the process proceeds to step S103. Alternatively, when it is determined that the acquired print image is not the image with character pixels, the process proceeds to step S104.

In step S103, a flag is attached to the character pixels. The reason for attaching the flag to the character pixels is to distinguish the character pixels from other pixels. In step S104, a color conversion process is performed. In this process, the data of the acquired print image is converted into the data of a CMKY format since the acquired print image has RGB image data. In step S105, a process associated with a halftone (middle tone) is performed. By this process, the data subjected to the color conversion process is converted into binary bit or multiple gray scale data which can be expressed by a printer. In this embodiment, the data does not depend on the number of gray scales which can express the dots of a printer. However, the data will be described as data which can express black and white binary bits for easy explanation.

In step S106, it is determined whether the pixels of the acquired print image are printed by the overlapping section 8 of the line head 4.

In step S106, when it is determined that the pixels of the acquired print image are not printed by the overlapping section 8, it is necessary to print the pixels of the acquired print image in a section other than the overlapping section 8 of the line head 4. Accordingly, the process proceeds to step S107. Then, the printing is assigned to the corresponding one of the basic heads 41 and 42.

Alternatively, when it is determined that the pixels of the acquired print image are printed by the overlapping section 8 in step S106, the process proceeds to step S108. In step S108, it is determined whether the print image is the image with the character pixels.

When it is determined that the print image is not the image with the character pixels in step S108, the process proceeds to step S109. In step S109, the printing is assigned to both the basic heads 41 and 42 at random or in accordance with a predetermined rule, since the image is not the image with the character pixels but is an image such as a ground image.

Alternatively, when it is determined that the print image is the image with the character pixels in step S108, the process proceeds to steps S110 and S111. In steps S110 and S111, it is determined whether the character (the character pixels) is printed across both the overlapping section 8 and the section other than the overlapping section 8 of the line head 4 in a connection-printing manner. The "connection-printing" refers to printing in which dots are continuously formed across both the overlapping section 8 and the section other than the overlapping section 8.

Figure 6:
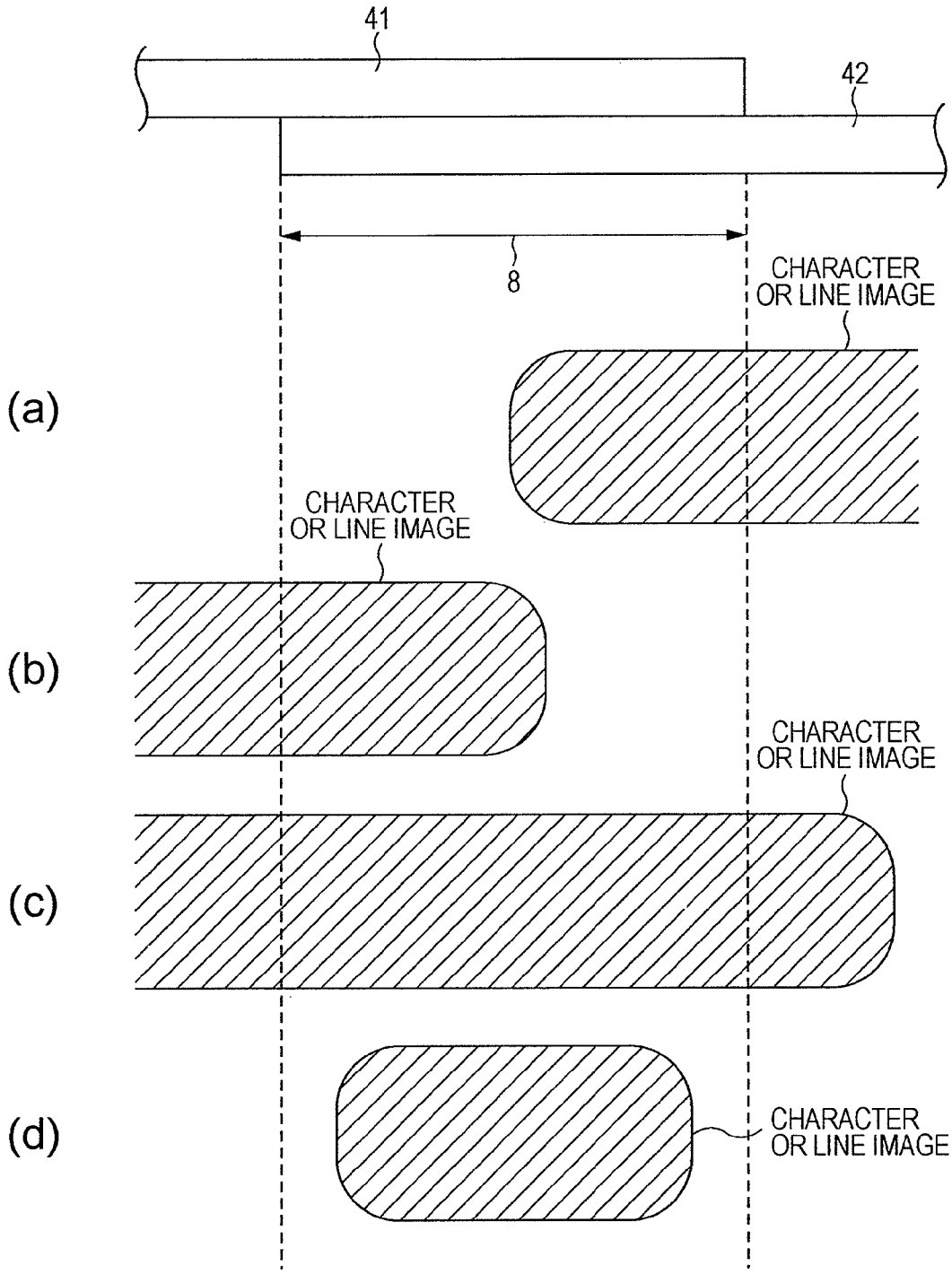
FIG. 6 is an explanatory diagram illustrating the determination in an overhead section in the exemplary first determination process.

In step S110, it is determined whether the printing target character is printed across only the right boundary of the overlapping section 8 in the connection-printing manner, as shown in part (a) of FIG. 6.

When the printing target character is printed across only the right boundary of the overlapping section 8 in the connection-printing manner in step S110, the process proceeds to step S112. In step S112, the printing of the character is assigned to the right basic head 42.

Alternatively, when the printing target character is not printed across only the right boundary of the overlapping section 8 in the connection-printing manner in step S110, the process proceeds to step S111. In step S111, it is determined whether the printing target character is printed across only the left boundary of the overlapping section 8 in the connection-printing manner, as shown in part (b) of FIG. 6.

When the printing target character is printed across only the left boundary of the overlapping section 8 in step S111, the process proceeds to step S113. In step S113, the printing of the character is assigned to left basic head 41.

Alternatively, when the printing target character is not printed across only the left boundary of the overlapping section 8 in step S111, the process proceeds to step S114. When the process proceeds to step S114, there are cases of the print status of the character, as shown in part (c) and part (d) of FIG. 6.

That is, in the case shown in part (c) of FIG. 6, the printing target character is printed across both the right and left boundaries of the overlapping section 8 in the connection-printing manner. In the case shown in part (d) of FIG. 6, the printing target character is not printed across both the right and left boundaries of the overlapping section 8, but printed in the overlapping section 8. In the cases, only one of the basic heads 41 and 42 are used in printing the character by the overlapping section 8.

Accordingly, in step S114, the printing is assigned to one of the basic heads 41 and 42 in accordance with the predetermined assignment rule.

In step S115, print data (nozzle control data indicating whether to eject ink) used to eject the ink from all the nozzles of the assigned basic heads 41 and 42 are generated on the basis of the assignment to the basic heads 41 and 42 in steps S107, S109, and S112 to S114.

In step S116, the generated print data are stored in the storage unit 300. The print data used to eject the ink from the nozzles 410 of the basic head 41 are stored in the first storage area 301. The print data used to eject the ink from the nozzles 420 of the basic head 42 are stored in the second storage area 302.

The print control unit 500 reads the print data stored in the storage unit 300 at predetermined time and controls the ejection of the ink from the nozzles 410 of the basic head 41 or the nozzles 420 of the basic head 42 on the basis of the read print data.

Figure 7:
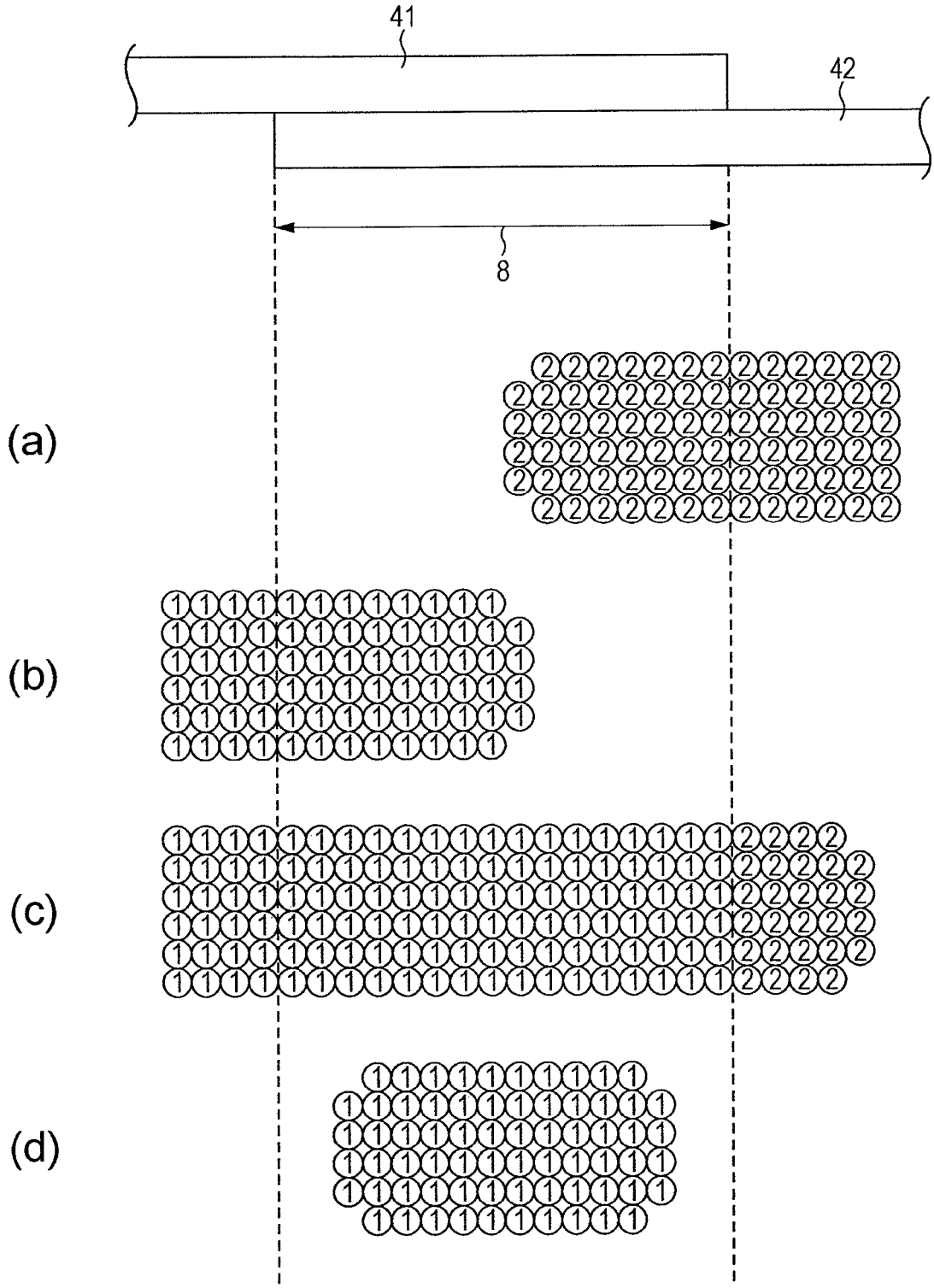
FIG. 7 is a diagram illustrating a print example in accordance with the exemplary first determination process.

FIG. 7 is a diagram illustrating a print example in accordance with the exemplary first determination process.

In FIG. 7, circles indicates dots formed by ejecting the ink from the nozzles 410 of the basic head 41 and the nozzles 420 of the basic head 42. Numeral "1" in the circles represents the dots foamed by the nozzles 410 and Numeral "2" in the circles represents the dots formed by the nozzles 420.

Part (a) of FIG. 7 shows a print example when the printing target character is printed across only the right boundary of the overlapping section 8 in the connection-printing manner (see part (a) of FIG. 6). Part (b) of FIG. 7 shows a print example when the printing target character is printed across only the left boundary of the overlapping section 8 in the connection-printing manner (see part (b) of FIG. 6).

Part (c) of FIG. 7 shows a print example when the printing target character is printed across both the right and left boundaries of the overlapping section 8 in the connection-printing manner (see part (c) of FIG. 6). Part (d) of FIG. 7 shows a print example when the printing target character is printed by the overlapping section 8 in the connection-printing manner (see part (d) of FIG. 6).

As described above, according to the exemplary first determination process, it is possible to improve the image quality in printing the character by the overlapping section 8, even when the head line 4 includes the overlapping section 8.

In particular, when the character is printed across both the overlapping section and the section other than the overlapping section in the connection-printing manner, it is possible to prevent the quality of the character from deteriorating.

Exemplary Second Determination Process

Next, an exemplary second determination process of the image determination processing unit 200 of the printing apparatus according to this embodiment will be described with reference to FIG. 8.

The outline of the exemplary second determination processing process is as follows.

The print image to be printed by the line head 4 is divided into a line image such as a figure and others, printing the line image and the others are assigned to the basic heads 41 and 42 in accordance with this division, and the line image and the others are printed by the assigned basic heads.

Hereinafter, the exemplary second determination process will be described in more detail.

In step S201, the line head 4 acquires the print image to be printed. In step S202, it is determined whether the acquired print image is a line image with line image pixels, such as a figure. When it is determined that the acquired print image is the line image with line image pixels, the process proceeds to step S203. Alternatively, when it is determined that the acquired print image is not the line image with line image pixels, the process proceeds to step S204.

In step S203, a flag is attached to the line image pixels. The reason for attaching the flag to the line image pixels is to distinguish the line image pixels from other pixels. In step S204, the color conversion process is performed. In step S205, a process associated with the halftone (middle tone) is performed.

In step S206, it is determined whether the pixels of the acquired print image are printed by the overlapping section 8 of the line head 4.

In step S206, when it is determined that the pixels of the acquired print image are not printed by the overlapping section 8, the process proceeds to step S207. Then, the printing is assigned to the corresponding one of the basic heads 41 and 42.

Alternatively, when it is determined that the pixels of the acquired print image are printed by the overlapping section 8 in step S206, the process proceeds to step S208. Then, it is determined whether the print image is the image with the line image pixels.

When it is determined that the print image is not the image with the line image pixels in step S208, the process proceeds to step S209. In step S209, the printing is assigned to both the basic heads 41 and 42 at random or in accordance with a predetermined rule, since the print image is not the image with the line image pixels but an image such as a ground image.

Alternatively, when it is determined that the print image is the image with the line image pixels in step S208, the process proceeds to steps S210 and S211. In steps S210 and S211, it is determined whether the line image (the line image pixels) is printed across both the overlapping section 8 and the section other than the overlapping section 8 of the line head 4 in a connection-printing manner.

In step S210, it is determined whether the printing target line image is printed across only the right boundary of the overlapping section 8 in the connection-printing manner, as shown in part (a) of FIG. 6.

When the printing target line image is printed across only the right boundary of the overlapping section 8 in the connection-printing manner in step S210, the process proceeds to step S212. In step S212, the printing of the line image is assigned to the right basic head 42.

Alternatively, when the printing target line image is not printed across only the right boundary of the overlapping section 8 in the connection-printing manner in step S210, the process proceeds to step S211. In step S211, it is determined whether the printing target line image is printed across only the left boundary of the overlapping section 8 in the connection-printing manner, as shown in part (b) of FIG. 6.

When the printing target line image is printed across only the left boundary of the overlapping section 8 in step S211, the process proceeds to step S213. In step S213, the printing of the line image is assigned to left basic head 41.

Alternatively, when the printing target line image is not printed across only the left boundary of the overlapping section 8 in step S211, the process proceeds to step S214. When the process proceeds to step S214, there are cases of the print status of the line image, as shown in part (c) and part (d) of FIG. 6.

That is, in the case shown in part (c) of FIG. 6, the printing target line image is printed across both the right and left boundaries of the overlapping section 8 in the connection-printing manner. In the case shown in part (d) of FIG. 6, the printing target line image is not printed across both the right and left boundaries of the overlapping section 8, but printed by the overlapping section 8. In the cases, only one of the basic heads 41 and 42 are used in printing the line image in the overlapping section 8.

Accordingly, in step S214, the printing is assigned to one of the basic heads 41 and 42 in accordance with the predetermined assignment rule in printing the line image.

In step S215, print data (nozzle control data indicating whether to eject ink) used to eject the ink from all the nozzles of the assigned basic heads 41 and 42 are generated on the basis of the assignment to the basic heads 41 and 42 in steps S207, S209, and S212 to S214.

In step S216, the generated print data are stored in the storage unit 300. The print data used to eject the ink from the nozzles 410 of the basic head 41 are stored in the first storage area 301. The print data used to eject the ink from the nozzles 420 of the basic head 42 are stored in the second storage area 302.

The print control unit 500 reads the print data stored in the storage unit 300 at a predetermined time and controls the ejection of the ink from the nozzles 410 of the basic head 41 or the nozzles 420 of the basic head 42 on the basis of the read print data.

As described above, according to the exemplary second determination process, it is possible to print the line image, as in the case of the character in the exemplary first determination process (see FIG. 7).

Accordingly, according to the exemplary second determination process, it is possible to improve the image quality in printing the line image such as a figure by the overlapping section 8, even when the head line 4 includes the overlapping section 8.

In particular, when the line image is printed across both the overlapping section and the section other than the overlapping section in the connection-printing manner, it is possible to prevent the quality of the line image from deteriorating.

Exemplary Third Determination Process

In the above-described exemplary first determination process, it is determined whether the print image to be printed by the line head 4 is an image printed by the overlapping section 8. When it is determined that the print image is the image printed by the overlapping section 8, it is determined whether a character is contained in the print image. When it is determined that the character is contained in the print image, it is determined whether the character is printed across the right and left boundaries of the overlapping section 8. In accordance with the determination result, the contained character is printed in the overlapping section 8 by a predetermined one of the basic heads 41 and 42 in the overlapping section 8.

In this print example, the printing may be performed, as in FIG. 7, for example. In FIG. 7, the character printed by the overlapping section 8 is printed by only one of the basic heads 41 and 42. However, when the character is printed across the right and left boundaries of the overlapping section 8 in the connection-printing manner (the case of part (c) of FIG. 7), the character printed near the boundaries of the overlapping section 8 may be printed by both the basic heads 41 and 42 in the overlapping section 8.

Figure 5:
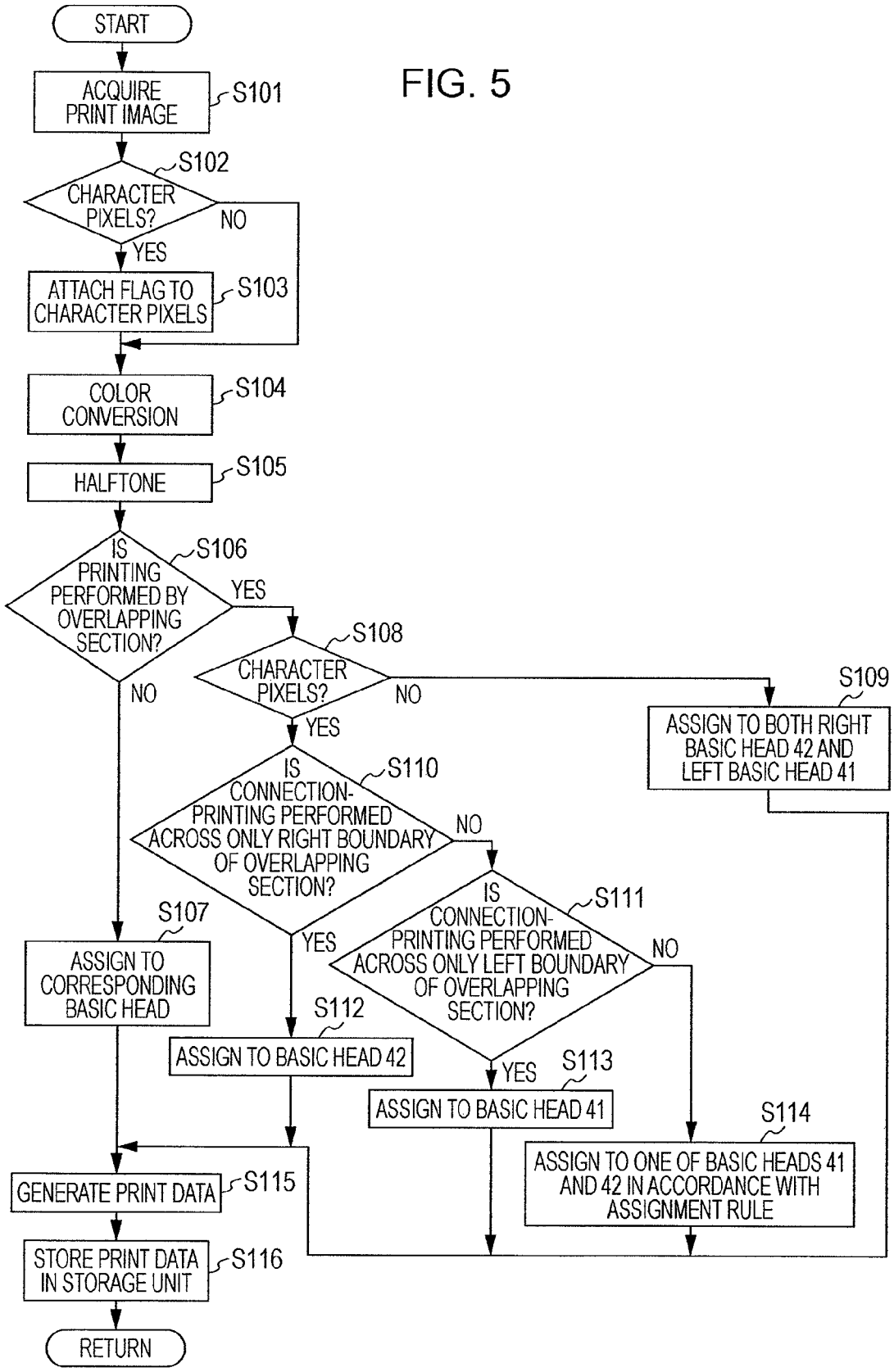
FIG. 5 is a flowchart for explaining an exemplary first determination process.

In an exemplary third determination process, the exemplary first determination process is performed basically (see FIG. 5). In addition, when the character is printed across the right and left boundaries of the overlapping section 8, the following process is added. That is, as for the character printed near the boundaries of the overlapping section 8, the printing is assigned to both the basic heads 41 and 42 in the overlapping section 8 in accordance with a predetermined rule. The character is printed by the assigned basic heads 41 and 42.

Figure 9:
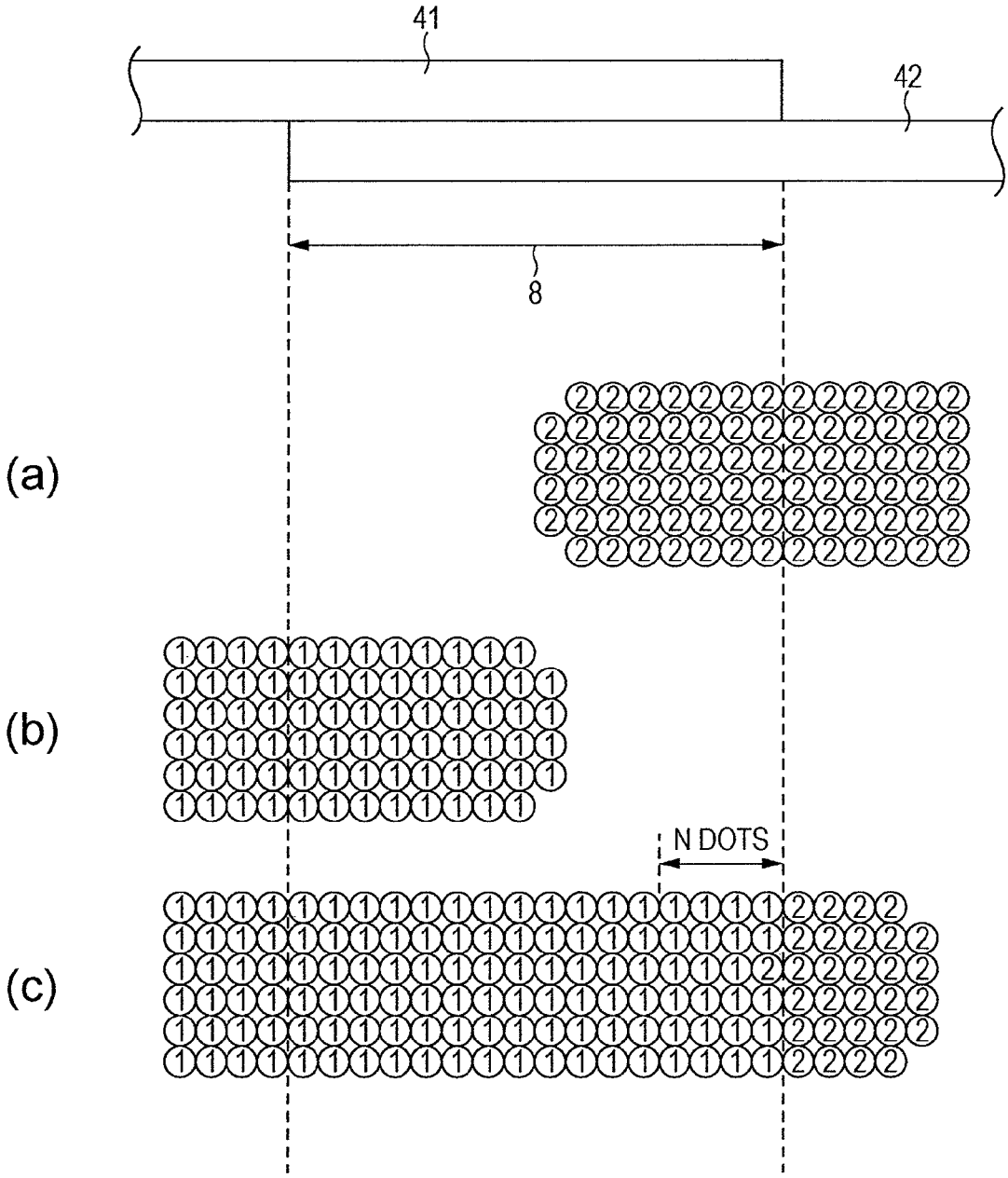
FIG. 9 is a diagram illustrating a print example in accordance with an exemplary third determination process.

FIG. 9 is a diagram illustrating a print example of the character printed in accordance with the exemplary third determination process. The print example in part (a) to part (c) of FIG. 9 corresponds to the print example in part (a) to part (c) of FIG. 7.

That is, when the character is printed across only the right boundary of the overlapping section 8 in the connection-printing manner, the printing is assigned to the basic head 42, as in step S110 or S210 (see part (a) of FIG. 9). When the character is printed across only the left boundary of the overlapping section 8, the printing is assigned to the basic head 41, as in step S111 or S211 (see part (b) of FIG. 9). When the character is printed across the right and left boundaries of the overlapping section 8, the printing is assigned to both the basic heads 41 and 42 in accordance with the predetermined rule. In part (c) of FIG. 9, the printing is assigned to the basic heads 41 and 42 in an area corresponding to one dot from the right boundary of the overlapping section 8 in an area printable by the overlapping section 8. In addition, the printing is assigned to the basic head 41 capable of performing the printing in an area containing the left boundary in an area other than the area printable by the overlapping section 8.

In the example of FIG. 9, the area printed by both the basic heads 41 and 42 is set to an area corresponding to one dot near the boundary of the overlapping section 8. However, the area may be set to an area corresponding to N dots (see part (c) of FIG. 9).

In FIG. 9, even when the character is printed across the right and left boundaries of the overlapping section 8 in the connection-printing manner, it is possible to prevent the quality of the character in the boundary from deteriorating.

The exemplary third determination process is applicable to both the above-described exemplary first and second determination processes.

Figure 8:
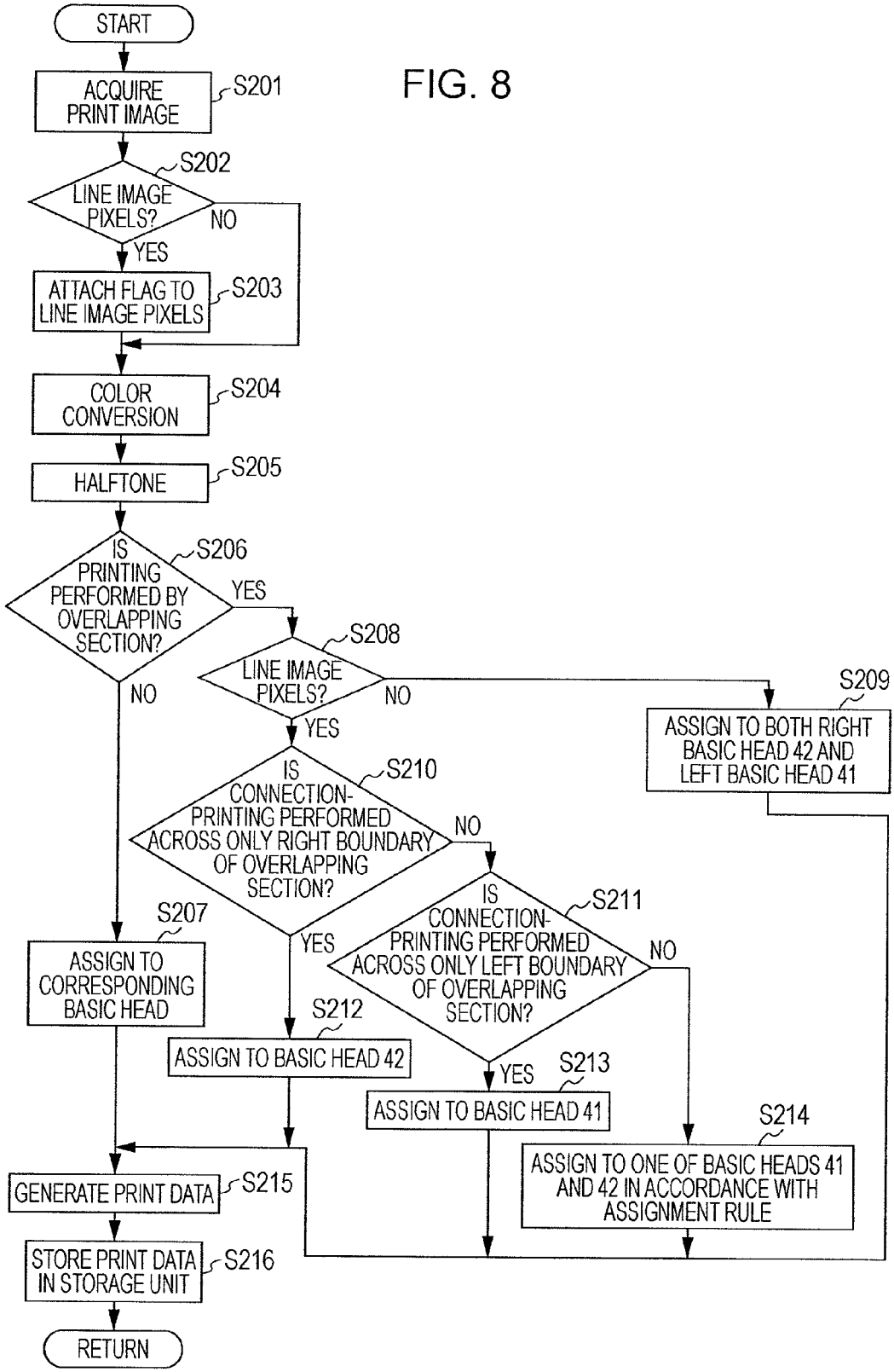
FIG. 8 is a flowchart for explaining an exemplary second determination process.

In this case, the exemplary second determination process is performed basically (see FIG. 8). In addition, when the line image is printed across the right and left boundaries of the overlapping section 8 in the connection-printing manner (which corresponds to step S214), the following process may be added. That is, as for the line image printed near the boundaries of the overlapping section 8, the printing is assigned to both the basis heads 41 and 42 in the overlapping section 8 in accordance with a predetermined rule, and the line image near the boundaries is printed by the assigned basic heads 41 and 42.

Exemplary Fourth Determination Process

In the above-described exemplary first determination process, the determination process is performed, as in the above-described exemplary third determination process.

In this print example, the printing may be performed, as in FIG. 7, for example. In FIG. 7, the entire character printed in the overlapping section 8 is printed by only one of the basic heads 41 and 42. However, when the character is printed by the overlapping section 8, it is not necessary for a predetermined one of the basic heads 41 and 42 to print the entire character. That is, when the character is printed by the overlapping section 8, the contour of the character may be printed by one of the basic heads 41 and 42 in the overlapping section 8 and a portion other than the contour of the character may be printed by both the basic heads 41 and 42 in the overlapping section 8.

In an exemplary fourth determination process, the exemplary first determination process is performed basically (see FIG. 5). In addition, when the character is printed by the overlapping section 8, the following process is added. That is, the contour of the character is printed by one of the basic heads 41 and 42. The portion other than the contour of the character is printed by both the basic heads 41 and 42 in the overlapping section 8.

Figure 10:
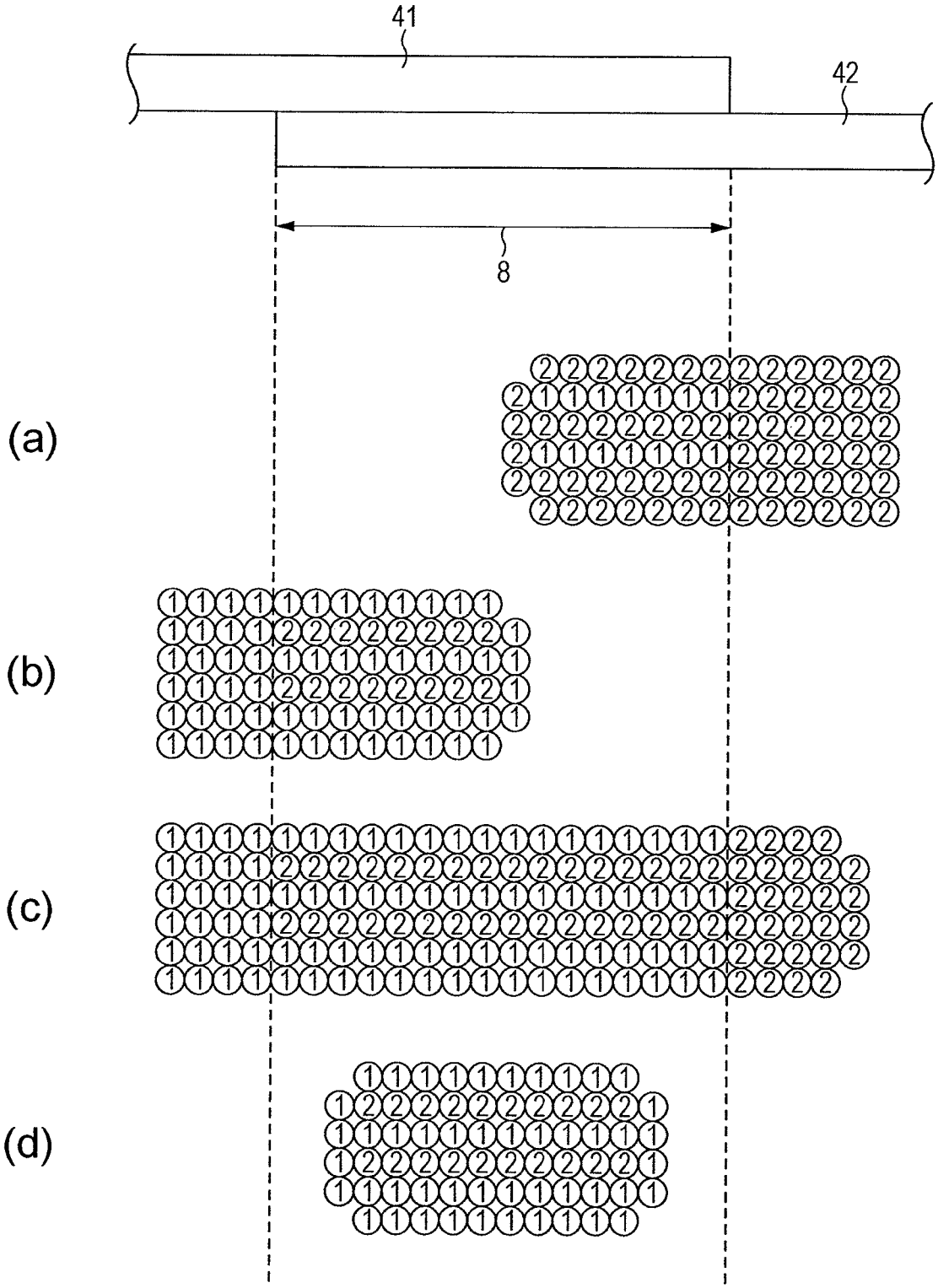
FIG. 10 is a diagram illustrating a print example in accordance with an exemplary fourth determination process.

FIG. 10 is a diagram illustrating a print example of the character printed in accordance with the exemplary fourth determination process. The print example in part (a) to part (d) of FIG. 10 corresponds to the print example in part (a) to part (d) of FIG. 7.

In FIG. 10, even when the line head 4 includes the overlapping section 8, it is possible to improve the quality of the printed character by the overlapping section 8.

The exemplary fourth determination process is applicable to both the above-described exemplary first and second determination processes.

In this case, the exemplary second determination process is performed basically (see FIG. 8). In addition, when the line image is printed in overlapping section 8, the following process may be added. That is, the contour of the line image is printed by one of the basic heads 41 and 42 in the overlapping section 8 and a portion other than the contour of the line image is printed by both the basic heads 41 and 42 in the overlapping section 8.

In part (a) of FIG. 10, since the character or the line image is printed across only the right boundary of the overlapping section 8 in the connection-printing manner, the printing is assigned to the basic head 42. In part (b) of FIG. 10, since the character or the line image is printed across only the left boundary of the overlapping section 8 in the connection-printing manner, the printing is assigned to the basic head 41. In part (c) of FIG. 10, since the character or the line image is printed in the right and left boundaries of the overlapping section 8 in the connection-printing manner, the printing is assigned to one of the basic heads 41 and 42 in accordance with a predetermined assignment rule. In part (d) of FIG. 10, since the character or the line image is not printed across the right and left boundaries of the overlapping section 8 in the connection-printing manner, the printing is assigned to one of the basic heads 41 and 42.

According to the above-described embodiment, the contour of the character or the line image can be printed by one of the basic heads, when the image printable in the overlapping section of the basic heads 41 and 42 contains the character or the line image. Therefore, it is possible to suppress the deterioration in a landing precision caused by a difference in the characteristics of the basic heads. Moreover, while ensuring high speed printing, it is possible to ensure a position precision of ink dots.

When the character or the line image passes over the overlapping section, the contour of the character or the line image can be printed by the basic head capable of printing the area containing the boundary over which the contour of the character or the line image passes. Therefore, it is possible to reduce a landing error in the boundary which is caused by different characteristics. Accordingly, it is possible to suppress the deterioration in the quality of the character or the line image printed across the boundaries.

Since the contour of the character or the line image passing over two boundaries of the overlapping section is printed by the same basic head and the portion other than the contour is printed by two basic heads, it is possible to perform the printing at a high speed, while suppressing the deterioration in the quality of the character or the line image.

Since an area of a predetermined width in the character or the line passing over the boundary of the overlapping section can be printed by two basic heads, it is possible to reduce the landing error in the boundary which is caused by the different characteristics. Accordingly, it is possible to suppress the deterioration in the quality of the character or the line image printed across the boundaries.

Case Where Basic Heads are Arranged in Three Rows

Figure 11:
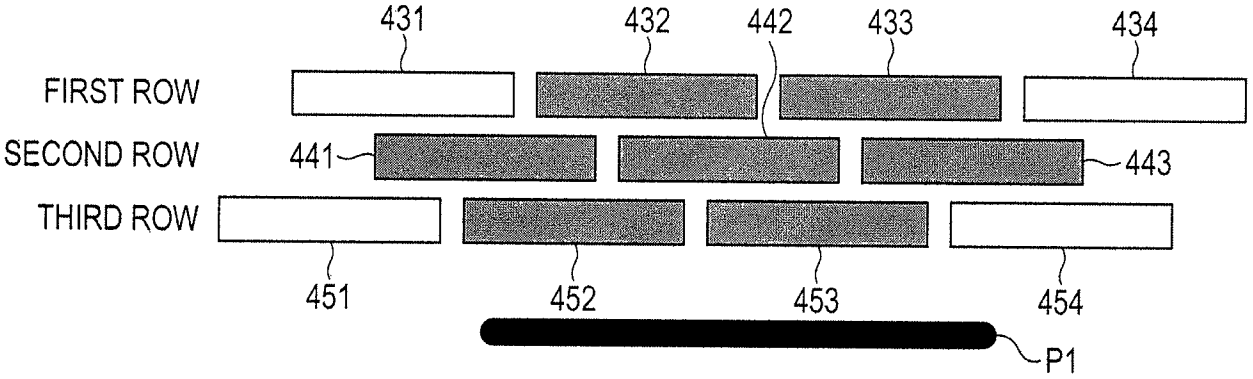
FIG. 11 is an explanatory diagram (first diagram) illustrating basic heads when the basic heads are arranged in three rows.

FIG. 11 is an explanatory diagram (first diagram) illustrating the basic heads when the basic heads are arranged in three rows. The drawing shows the basic heads in a view from the upper side for easy description.

In the drawing, basic heads 431, 432, 433, and 434 are arranged in first row basic heads in a direction of the nozzle row. Basic heads 441, 442, and 443 are arranged as second row basic heads in the direction of the nozzle row. Basic heads 451, 452, 453, and 454 are arranged as third basic heads in the direction of the nozzle row.

The basic head 441 is disposed at a position where the basic head 441 overlaps with the parts of the basic heads 431, 432, 451, and 452 in the direction of the nozzle row. The basic head 442 is disposed at a position where the basic head 442 overlaps with the parts of the basic heads 432, 433, 452, and 453 in the direction of the nozzle row. The basic head 443 is disposed at a position where the basic head 443 overlaps with the parts of the basic heads 433, 434, 453, and 454 in the direction of the nozzle row.

In FIG. 11, a line image P1 printed by the basic heads is shown. The line image P1 is a line image which can be sufficiently formed by the nozzle at the left end of the basic head 452 to the nozzle at right end of the basic head 433.

Upon printing such a line image P1, the basic head 431 also overlaps with a part of the line image P1 in the direction of the nozzle row. Therefore, when the basic head 431 is used, the printing can also be performed. In this embodiment, however, at least the basic head 431 is not used in printing the contour of the line image P1. Near the left end of the line image P1, the contour of the line image P1 is printed by the basic head 452. Near the left end of the line image P1, at least one of the basic heads 431, 441, and 452 is used in printing the inside (portion other than the contour) of the line image P1. At this time, the basic head 452 corresponds to a second basic head and the basic head 431 corresponds to a first basic head.

The basic head 454 in focusing on the right end of the line image P1 also overlaps with a part of the line image P1 in the direction of the nozzle row. Therefore, the basic head 454 can be used originally in printing the line image P1. In this embodiment, however, at least the basic head 454 is not used in printing the contour of the line image P1. Near the right end of the line image P1, the contour of the line image P1 is printed by the basic head 433. Near the right end of the line image P1, at least one of the basic heads 433, 443, and 454 is used in printing the inside of the line image P1. At this time, the basic head 433 corresponds to the first basic head and the basic head 454 corresponds to the second basic head.

Figure 12:
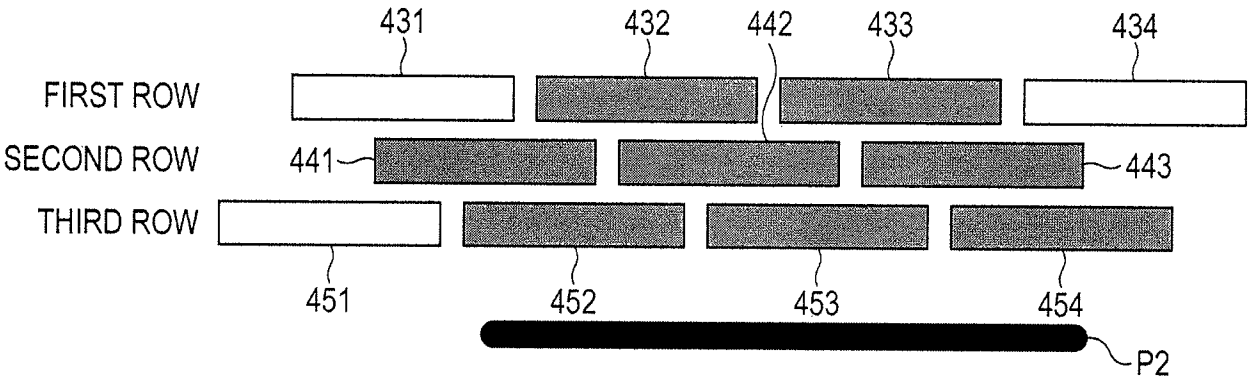
FIG. 12 is an explanatory diagram (second diagram) illustrating basic heads when the basic heads are arranged in three rows.

FIG. 12 is an explanatory diagram (second diagram) illustrating the basic heads when the basic heads are arranged in three rows. In the drawing, the arrangement method of the basic heads is the same as that of FIG. 11. In FIG. 12, the right end of a line image P2 overlaps with a part of the basic head 434 in the direction of the nozzle row.

Accordingly, even when the basic head 434 is used, the printing can also be performed. In this embodiment, however, at least the basic head 434 is not used in printing the contour of the line image P2. Near the right end of the line image P2, the contour of the line image P2 is printed by the basic head 443. Near the right end of the line image P2, at least one of the basic heads 434, 443, and 454 is used in printing the inside of the line image P2. At this time, the basic head 443 corresponds to the first basic head and the basic head 454 corresponds to the second basic head.

Figure 13:
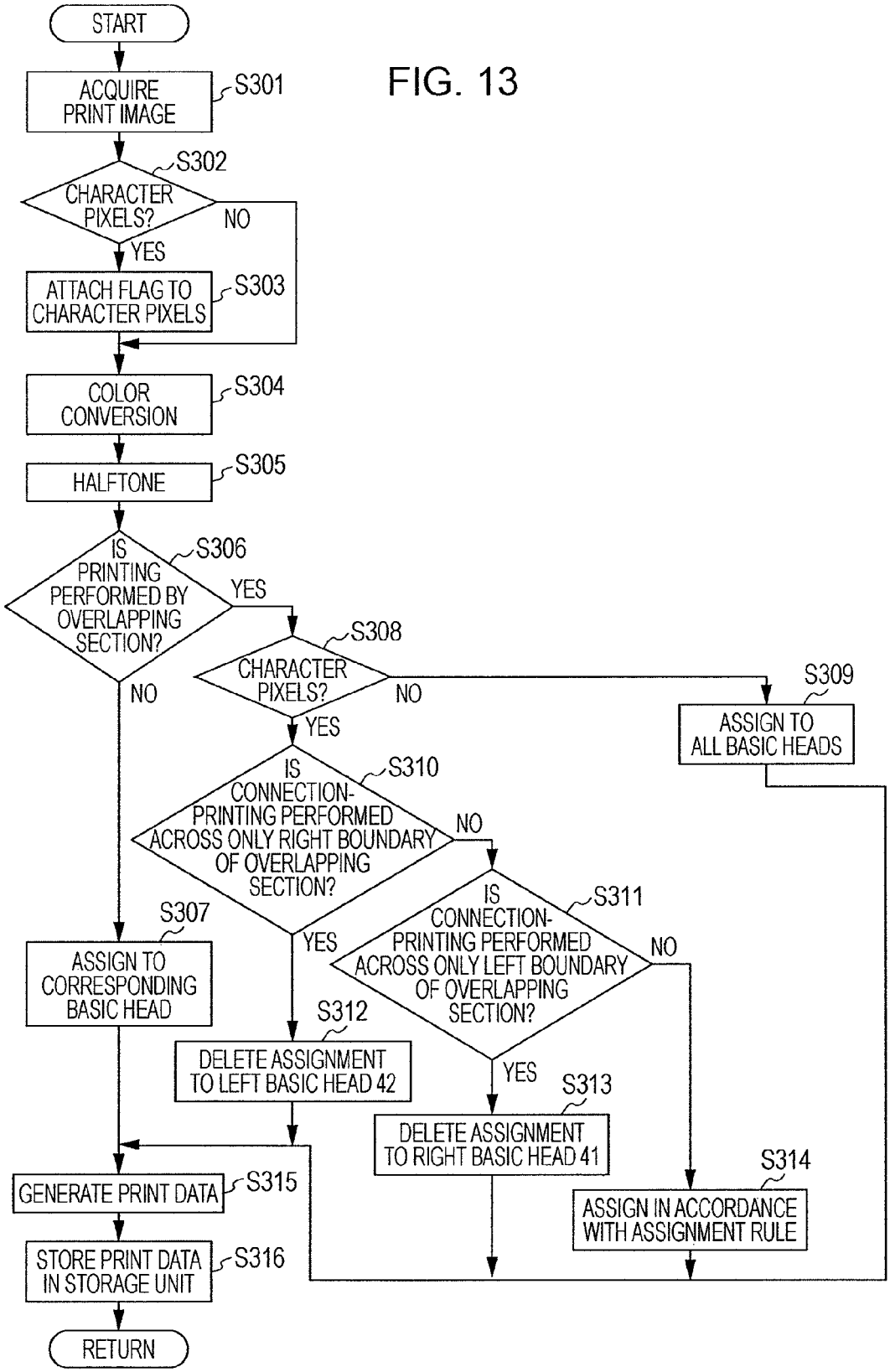
FIG. 13 is a flowchart for explaining an exemplary determination process when the basic heads are arranged in three rows.

FIG. 13 is a flowchart for explaining an exemplary determination process when the basic heads are arranged in three rows. In this embodiment, since the same processes are performed except for steps S209, S212, S213, and S214 of the flowchart in FIG. 5, the description of the same processes is omitted and only different processes will be described.

When it is determined that the connection-printing is performed across only the right boundary of the overlapping section in step S310, dot formation is assigned so that the dot formation is not assigned to the left head in printing the contour of the overlapping section (S312). Here, the "left head" refers to a basic head of which the left end is located on the most left side among three basic heads when the basic heads are arranged in three rows in the aimed overlapping section. The "the left head" or the like is predetermined so as to correspond to the overlapping section. This correspondence relation is described below.

When it is determined that the connection-printing is performed across only the left boundary of the overlapping section in step S311, dot formation is assigned so that the dot formation is not assigned to the right head in printing the contour of the overlapping section (S313). Here, the "right head" refers to a basic head of which the right end is located on the most left side among three basic heads when the basic heads are arranged in three rows in the aimed overlapping section.

On the other hand, when the line image does not pass over either the right boundary or the left boundary of the overlapping section, the dot formation is assigned in accordance with a predetermined assignment rule (S314). Here, as an example of the predetermined assignment rule, the dots formed by the three overlapping basic heads are arranged one by one in the transport direction of a sheet.

Even when a printing target image is not an image with character pixels (or line image pixels), pixel formation is assigned to the overlapping basic heads at random or in accordance with a predetermined rule (S309).

Figure 14:
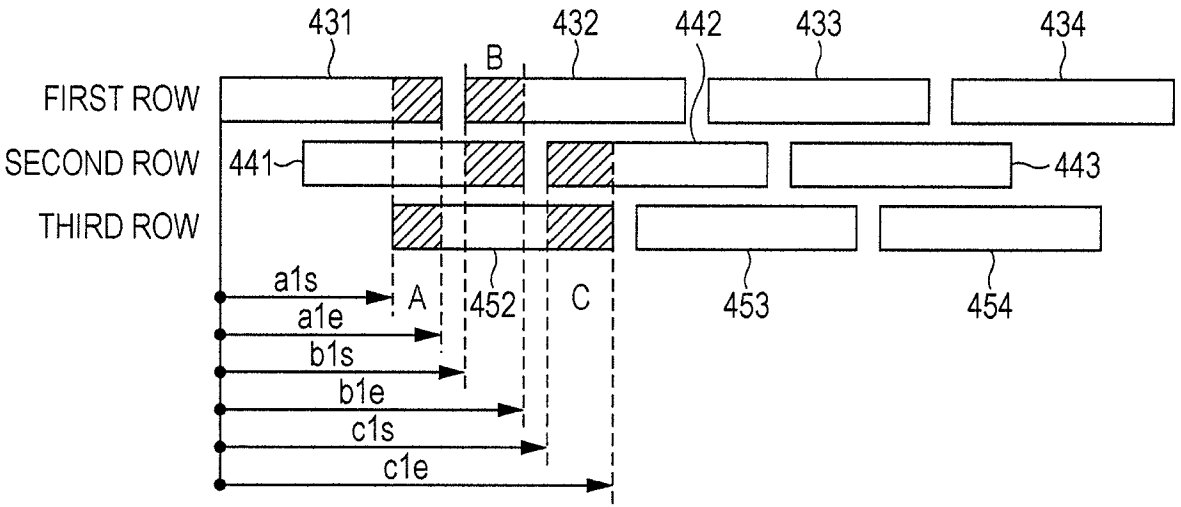
FIG. 14 is a diagram illustrating the basic heads used in each overlapping section.

FIG. 14 is a diagram illustrating the basic heads used in each overlapping section. FIG. 14 shows the basic heads 431, 432, 433, and 434 arranged in a first row, the basic heads 441, 442, and 443 arranged in a second row, and the basic heads 451, 452, 453, and 454 arranged in a third row. As ranges in which three basic heads overlap with each other in the arranged direction of the nozzles, overlapping sections A, B, and C are shown. In addition, distances between the left end of the first row basic head 431 and the start points of the overlapping sections and distances between the left end of the first row basic head 431 and the end points of the overlapping sections are illustrated.

FIG. 15 is a table used to explain the basic heads used in each overlapping section. The table shows which basic head corresponds to the above-described "left head" or "right head" by the overlapping sections A, B, and C shown in FIG. 14. The table also shows which row head serves as the "left head" in the corresponding overlapping section and which row head serves as the "right head" in the corresponding overlapping section. In this way, when the basic heads are arranged in three rows, the ranges in which the ends of the basic heads overlap with each other in the direction of the nozzle row become the overlapping sections.

For example, as for the overlapping section A shown in FIG. 14, the range in which the first row basic head 431 serving as the left head and the third row basic head 452 serving as the right head overlap with each other is defined as the overlapping section A. In this case, the basic head 431 corresponds to the first basic head and the basic head 452 corresponds to the second basic head. When a character or a line image is printed by the overlapping section, the contour of the character or the line image is printed by the basic head 431 corresponding to the first basic head and the basic head 452 corresponding to the second basic head is not used in printing the contour of the character or the line image.

FIG. 16 is a diagram illustrating an example of the table used to explain the overlapping sections. FIG. 16 shows the start points and the end points defined by the distances from the left end of the basic head 431 in FIG. 14. FIG. 16 shows whether each start point and each end point form the overlapping section. For example, no overlapping section exits between a start point "0" and an end point "a1*s*". The overlapping section A exists between the start point "a1*s*" and the end point "a1*e*". In this way, the overlapping sections are defined in advance on the basis of the distances from the end of the basic heads.

Figure 17:
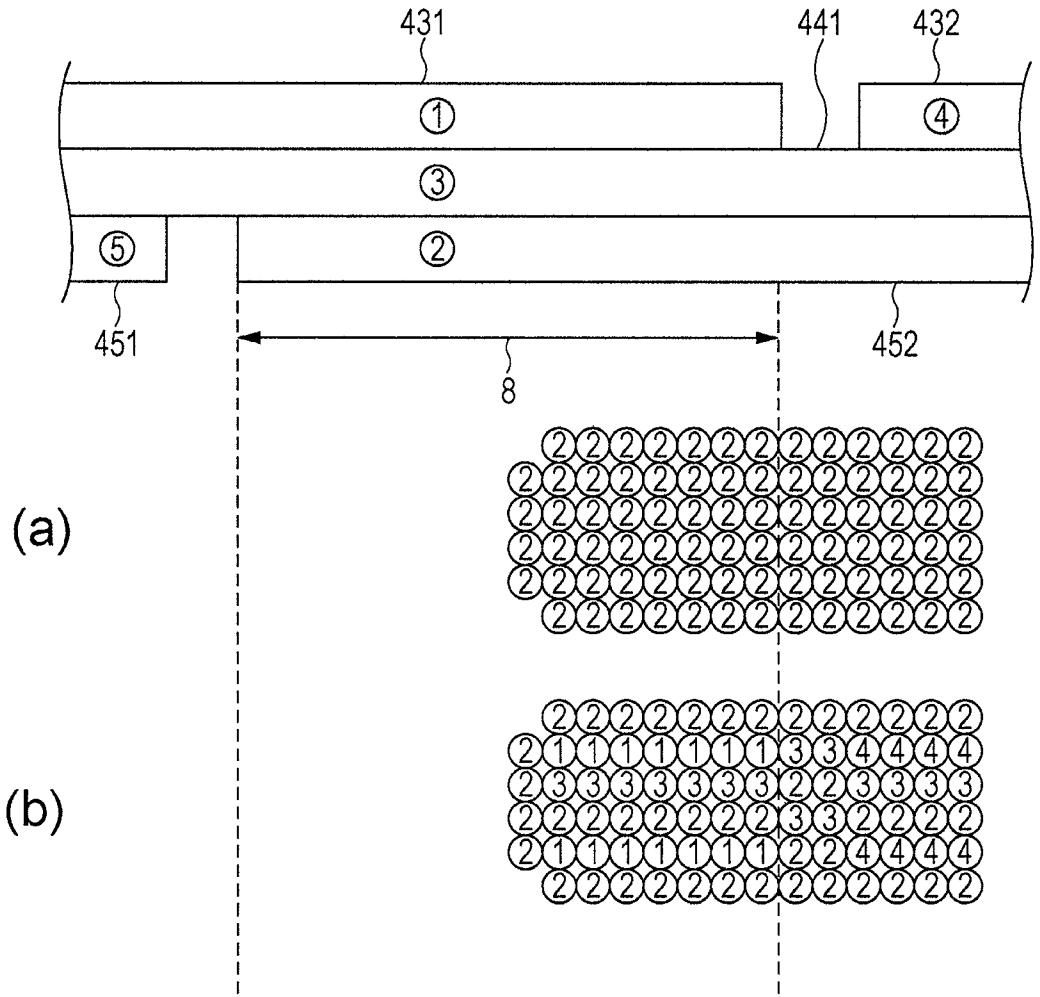
FIG. 17 is a diagram (first diagram) illustrating a specific example where the dots are formed when the basic heads are arranged in three rows.

FIG. 17 is a diagram (first diagram) illustrating a specific example where the dots are formed when the basic heads are arranged in three rows. FIG. 17 shows the plurality of basic heads which are located near the left end of the line image P1 in FIG. 11. In addition, the dot formation at the left end of the line image P1 is shown. In the formed line image, numerals are given so as to know that the dots are formed by which basic heads. Likewise, numerals are given to the corresponding basic heads.

In an example part (a) of FIG. 17, all dots including the dots of the contour of the line image P1 in the overlapping section are formed by the basic head 452. The portion of the line image P1 on the right side of the overlapping section is also formed by the basic head 452.

In an example of part (b) of FIG. 17, the contour of the line image P1 in the overlapping section is formed by the basic head 452. The inside of the line image P1 in the overlapping section is formed by the basic heads 431, 441, and 452.

The contour of the line image P1 on the right side of the overlapping section is formed by the basic head 452. The inside of the line image P1 on the right side of the overlapping section is formed by the basic heads 441 and 452 or by the basic heads 441 and 452 in addition to the basic head 432.

The basic head 431 corresponds to the first basic head and the basic head 452 corresponds to the second basic head. In this way, the contour of the line image is configured to be printed not by the other of the first and second basic heads but by one of the first and second basic heads.

Figure 18:
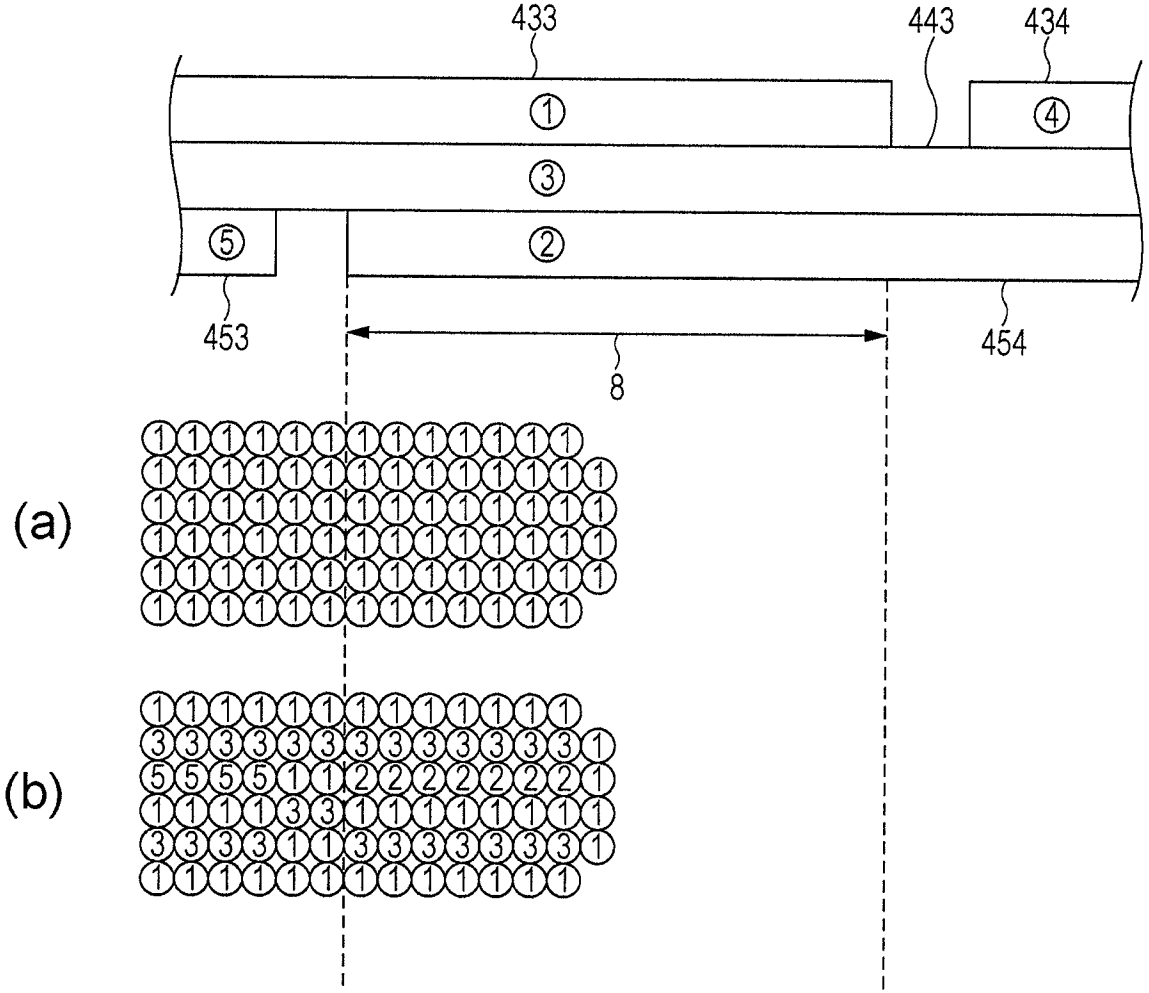
FIG. 18 is a diagram (second diagram) illustrating a specific example where the dots are formed when the basic heads are arranged in three rows.

FIG. 18 is a diagram (second diagram) illustrating a specific example where the dots are formed when the basic heads are arranged in three rows. FIG. 18 shows the plurality of basic heads which are located near the right end of the line image P1 in FIG. 11. In addition, the dot formation at the right end of the line image P1 is shown. In the formed line image, numerals are given so as to know that the dots are formed by which basic heads. Likewise, numerals are given to the corresponding basic heads.

In an example of part (a) of FIG. 18, all dots including the dots of the contour of the line image P1 in the overlapping section are formed by the basic head 433. The portion of the line image P1 on the left side of the overlapping section is also formed by the basic head 433.

In an example of part (b) of FIG. 18, the contour of the line image P1 in the overlapping section is formed by the basic head 433. The inside of the line image P1 in the overlapping section is formed by the basic heads 433, 443, and 454.

The contour of the line image P1 on the left side of the overlapping section is formed by the basic head 433. The inside of the line image P1 on the right side of the overlapping section is formed by the basic heads 433 and 443 or by the basic heads 433 and 443 in addition to the basic head 453.

The basic head 433 corresponds to the first basic head and the basic head 454 corresponds to the second basic head. In this way, the contour of the line image is configured to be printed not by the other of the first and second basic heads but by one of the first and second basic heads.

Modified Examples (1) As an exemplary fifth determination process, the determination process may be performed by appropriately combining the exemplary first to fourth determination processes in accordance with the characteristics of a printing target image.

(2) As the case of the printing by the overlapping section 8, the printing is assigned to one of the basic heads 41 and 42 in the overlapping section 8 in accordance with the predetermined assignment rule. The assignment rule may newly be changed in every page or every document.

(3) In the above-described embodiment, the ink is landed onto the sheet 7, but the ink may be landed onto any medium (print medium) onto which a liquid can be landed. Accordingly, in printing the ink onto a print medium such as cloth, it is possible to ensure a position precision of dots.

(4) In the above-described embodiment, the relative position of the line head 4 and the print medium is changed by transporting the sheet 7. However, when the relative position of the line head 4 and the print medium is changed, one of the line head 4 and the sheet 7 may be moved. Accordingly, in order to deal with the change in the relative position by the sheet transportation according to the above-described embodiment, the line head 4 may be moved relative to the print medium or both the print medium and the line head 4 may be moved.

(5) In the above-described embodiment, the program associated with each exemplary determination process is executed in the image determination processing unit 200. However, the program may be executed by a computer. In this case, the program is supplied in a form stored in a computer readable recording medium. As such a recording medium, there are used a variety of computer readable mediums such as a flexible disk, a CD-ROM, a magneto-optical disk, an IC card, a ROM cartridge, a punch card, a printing product in which signs such as barcode is printed, an internal storage device (a memory such as a RAM or a ROM) of a computer, and an external storage device of a computer.

(6) In the above-described embodiment, the input interface 100, the image determination processing unit 200, the storage unit 300, and the print control unit 500 are included in the printing apparatus, but the functions thereof may be realized in an image control apparatus such as a personal computer (PC) or a server. Likewise, steps S101 to S116 in FIG. 5 are executed in the printer, but steps S101 to any one step or steps S101 to S116 may be executed by the image control apparatus.

(7) In the description of FIG. 7, the circles indicate the dots formed by ejecting the ink from the nozzles 410 of the basic head 41 and the nozzles 420 of the basic head 42. However, one dot may be formed by one nozzle or one dot may be formed by two or more nozzles.

(8) In the descriptions of FIGS. 2, 3, 5, 6, 7, 8, 9 and 10, the basic head 42 is located on the downstream side of the basic head 41 in the transport direction. In addition, it is first determined whether the image passes only over the right boundary, and then it is determined whether the image passes only over the left boundary.

However, the invention is not limited thereto. The positions of the basic heads 41 and 42 may be reverse to each other. In addition, it may be first determined whether the image passes only over the left boundary, and then it may be determined whether the image passes only over the right boundary.

(9) In FIGS. 2 and 3, the overlapping section 8 is formed by the two basic heads, the basic heads 41 and 42. However, the overlapping section 8 may be formed by three or more basic heads. In this case, when a character or a line image is contained in the image printable by the overlapping section 8, the image is printed by one of the three or more basic heads.

(10) In FIG. 3, the nozzles of the two basic heads, the basic heads 41 and 42, are disposed so that the pitch of the nozzles becomes the same phase. However, the pitch of the nozzles of the two basic heads may not be the same phase, when the overlapping section 8 is formed.

(11) The invention is not limited to the above-described embodiment, but may be modified in various forms without departing from the gist of the invention within the scope of the invention.

The entire disclosure of Japanese Patent Application No. 2008-304148, filed Nov. 28, 2008 and 2009-172396, filed Jul. 23, 2009 are expressly incorporated by reference herein.

What is claimed is:

1. A printing apparatus comprising:

(A) a line head comprising first and second basic heads each comprising a plurality of nozzles in a predetermined direction, wherein the apparatus is configured such that both the first and the second basic heads eject ink, and wherein the first and second basic heads are arranged in the line head in the predetermined direction so as to form an overlapping section in the predetermined direction;

(B) an image determination processing unit, which determines whether any character or any line image is contained in a first portion of the acquired print image; wherein the first portion is printable by each of the first and second basic heads in the overlapping section; and (C) a controller which controls the first and second basic heads when at least one of a print medium and the line head moves in a direction intersecting the predetermined direction, wherein the controller controls the first and second basic heads so as to print the outline of the character or the line image by using only one of the first and second basic heads when the character or the line image is contained in the first portion, and controls the first and second basic heads so as to print the first portion of the acquired image by using both the first and second basic heads when no character or line image is contained in the first portion.

2. The printing apparatus according to claim 1, wherein the overlapping section has first and second boundaries in the predetermined direction, and wherein the determination processing unit further determines whether the character or the line image passes over the first or second boundary when the character or the line image is contained in the first portion, and the controller controls the first and second basic heads on the basis of the determination result.

3. The printing apparatus according to claim 2, wherein the controller controls the first and second basic heads so that one of the first and second basic heads capable of printing a second portion, which contains the boundaries over which the character or the line image passes, prints the outline of the character or the line image, when the character or the line image passes over one of the first and second boundaries.

4. The printing apparatus according to claim 2, wherein the controller controls the first and second basic heads so that only one of the first and second basic heads capable of printing a second portion, which contains the boundaries over which the character or the line image passes, prints the outline of the character or the line image, and both the first and second basic heads print other portions of the character or the line image in the second portion, when the character or the line image passes over one of the first and second boundaries.

5. The printing apparatus according to claim 2, wherein the controller controls the first and second basic heads so that the first and second basic heads print an area of a predetermined width from one of the first and second boundaries in the character or the line image, when the character or the line image passes over the first and second boundaries.

6. The printing apparatus according to claim 1, wherein a nozzle pitch of the first basic head is the same as a nozzle pitch of the second basic head.

7. The printing apparatus according to claim 1, wherein in the overlapping section, the first and second basic heads are disposed so that the nozzles of the first basic head and the nozzles of the second basic head overlap with each other in the predetermined direction.

8. A printing method performed by a printing apparatus comprising a line head which comprises first and second basic heads each comprising a plurality of nozzles in a predetermined direction, wherein the apparatus is configured such that both the first and the second basic heads eject ink, and wherein the first and second basic heads are arranged in the line head in the predetermined direction so as to form an overlapping section in the predetermined direction, the printing method comprising:

determining whether any character or any line image is contained in a first portion of the acquired print image, wherein the first portion is printable by each of the first and second basic heads in the overlapping section; and printing the outline of the character or the line image by using only one of the first and second basic heads when the character or the line image is contained in the first portion, and printing the first portion of the acquired image by using both the first and second basic heads when no character or line image is contained in the first portion.

9. A non-transitory computer-readable medium containing a program controlling a printing apparatus comprising a line head which comprises first and second basic heads each comprising a plurality of nozzles in a predetermined direction, wherein the apparatus is configured such that both the first and the second basic heads eject ink, and wherein the first and second basic heads are arranged in the line head in the predetermined direction so as to form an overlapping section in the predetermined direction, the program causing a computer to execute:

determining whether any character or any line image is contained in a first portion of the acquired print image, wherein the first portion is printable by each of the first and second basic heads in the overlapping section; and printing the outline of the character or the line image by using only one of the first and second basic heads when the character or the line image is contained in the first portion, and printing the first portion of the acquired image by using both the first and second basic heads when no character or line image is contained in the first portion.

* * * * *